US006597332B1

(12) United States Patent
Kanno et al.

(10) Patent No.: US 6,597,332 B1
(45) Date of Patent: Jul. 22, 2003

(54) PLASMA ADDRESSING DISPLAY DEVICE

(75) Inventors: Yoshihiro Kanno, Gifu (JP); Yoichi Morita, Gifu (JP); Takahiro Togawa, Gifu (JP); Hirohito Komatsu, Kanagawa (JP); Masatake Hayashi, Gifu (JP); Kiyoshi Okano, Gifu (JP)

(73) Assignees: Sony Corporation, Tokyo (JP); Sharp Kabushiki Kaisha, Osaka (JP)

( * ) Notice: Subject to any disclaimer, the term of this patent is extended or adjusted under 35 U.S.C. 154(b) by 455 days.

(21) Appl. No.: 09/626,074

(22) Filed: Jul. 26, 2000

(30) Foreign Application Priority Data

Aug. 6, 1999 (JP) ..... 11-224631
Jan. 31, 2000 (JP) ..... 2000-021599

(51) Int. Cl.[7] ..... G09G 3/28

(52) U.S. Cl. ..... 345/60; 345/62; 345/66; 345/67; 315/169.1; 315/169.2

(58) Field of Search ..... 345/60, 62, 66, 345/67; 315/169.1, 169.2, 169.4

(56) References Cited

U.S. PATENT DOCUMENTS 5,661,501 A * 8/1997 Tanamachi ..... 345/60
5,903,381 A * 5/1999 Watanabe et al. ..... 359/254
6,344,840 B1 * 2/2002 Taniguchi et al. ..... 345/60

* cited by examiner

*Primary Examiner*—Amare Mengistu
*Assistant Examiner*—Jimmy H. Nguyen
(74) *Attorney, Agent, or Firm*—Sonnenschein, Nath & Rosenthal

(57) ABSTRACT

A plasma addressing display device comprising a flat panel including a display cell having columns of signal electrodes and also including a plasma cell having rows of discharge channels, with pixels formed at intersections of the signal electrodes and the discharge channels; a scanning circuit for sequentially discharging the columns of the signal electrodes at a pre-set period to select pixels from row to row; and a signal circuit for supplying picture signals to the column of the signal electrodes to write the picture signals in the pixels of the selected row, the scanning circuit discharging each discharge channel with time shift as the discharging period allocated to the discharge channel of a previous row is partially overlapped at least with the discharging period allocated to the discharge channel of the next row to allocate a discharging period longer than the pre-set period to each discharge channel.

6 Claims, 10 Drawing Sheets

PLASMA ADDRESSING DISPLAY DEVICE

BACKGROUND OF THE INVENTION

1. Field of the Invention

This invention relates to a plasma addressing display device having a display cell and a plasma cell overlapped together. More particularly, it relates to a plasma cell scanning circuit structure and to a plasma cell scanning method.

2. Description of Related Art

A plasma addressing display device is disclosed in, for example, Japanese Laid-Open Patent H-4-265931. The plasma addressing display device has a flat panel structure comprising a display cell 1, a plasma cell 2 and a common intermediate sheet 3 interposed therebetween, as its structure is shown in FIG. 1. The intermediate sheet 3 is e.g., a glass plate of extremely thin thickness and is termed a micro-sheet. The plasma cell 2 is formed by a lower glass substrate 4 bonded to the intermediate sheet 3 and a dischargeable gas is charged in a gap in-between. On the inner surface of the lower glass substrate 4 A, there are formed striped discharge electrodes.

These discharge electrodes operate as anodes A and cathodes K Since the discharge electrodes can be printed on the flat glass substrate 4 by e.g., a screen printing method, superior productivity and operability can be assured. A number of partiyions 7 are formed so that a set of the anode A and the cathode K is delimited by two neighboring partitions 7 to constitute plural discharge channels 5 by dividing the gap in which is sealed a dischargeable gas.

These partitions 7 also can be fabricated by a screen printing method, with the upper ends of the partitions 7 bearing against a surface of the intermediate sheet 3. Plasma discharge is produced across the anode A and the cathode K of respective opposite polarities in a discharge channel 5 surrounded by the neighboring partitions 7. Meanwhile, the intermediate sheet 3 and the lower glass substrate 4 are bonded together by e.g., glass frit.

On the other hand, the display cell 1 is fabricated using a transparent upper glass substrate 8. This glass substrate 8 is bonded to the opposite side surface of the intermediate sheet 3 via a pre-set gap using e.g., a sealing material in a gap of the display cell 1 is sealed a liquid crystal 9 as an opto-electric material. On the inner surface of the upper glass substrate 8 are formed plural signal electrodes Y. On intersections of the signal electrodes Y and the discharge channels 5 are formed matrix-shaped pixels.

On the inner surface of the glass substrate 8 are also formed color filters 13 for allocating, e.g., three prime colors R, G and B to respective pixels. The flat panel of the above-described structure is of the transparent type and the plasma cell 2 is positioned at the incident side, whilst the display cell 1 is positioned on the exiting side. A backlight 12 is mounted on the side of the plasma cell 2.

In the plasma addressing display device, column-shaped discharge channels 5, in which occurs plasma discharge, arc line-sequentially scanned in a switching fashion. In synchronism with this scanning, picture signals are applied to the column-shaped signal electrodes Y on the display cell side to execute display driving.

When plasma discharge occurs in the discharge channels 5, the inside thereof is at a uniform anode potential such that pixels are selected on the row basis. That is, each discharge channel 5 corresponds to a scanning line, and operates as a sampling switch. If, with the plasma sampling switch on, picture signals are applied to the respective signal lines, sampling takes place to control pixel on/off.

The pixel signals are held in the pixels unchanged even after the plasma sampling switch is turned off. The display cell 1 is responsive to the pixel signals to modulate the incident light from the backlight 12 into outgoing light to display a picture.

FIG. 2. schematically shows only two pixels. FIG. 2 shows only two signal electrodes Y1, Y2, a sole cathode K1 and a sole anode A1 to aid in the understanding. Each pixel 11 is of a layered structure comprising signal electrodes Y1, Y2, a liquid crystal 9, an intermediate sheet 3 and a discharging channel. During plasma discharge, the discharge channel is connected to substantially an anode potential. If, in this state, picture signals are applied to the respective signal electrodes Y1, Y2, electrical charges are injected into the liquid crystal 9 and the intermediate sheet 3.

If the plasma discharge comes to a close, the discharge channel reverts to an insulated state, so that a floating potential prevails such that the injected charges are held in the respective pixels by way of a so-called sample-and-hold operation. So, the discharge channel operates as an individual sampling switch element, so that the respective pixels are schematically indicated with switching symbols S1.

The liquid crystal 9 and the intermediate sheet 3, held between the signal electrodes Y1, Y2 and the discharge channel, operate as sampling capacitors. When the sampling switch S1 is turned on by line sequential scanning, picture signals are written into the sampling capacitors. The respective pixels are turned on or off responsive to the picture signal level. The signal voltage is held on the sampling capacitor even after the sampling switch S1 is turned off to perform an active matrix operation of the display device. Meanwhile, the effective voltage applied to the liquid crystal is determined by capacitance division with respect to the intermediate sheet 3.

FIG. 3 is a timing chart showing the scanning processing timing for sequentially discharging the column-shaped discharge channel and the signal processing timing for writing in respective pixels by supplying picture signals to the column-shaped signal electrodes. The routine practice is to complete the discharging of relevant discharge channels and writing of picture signals in relevant pixels within a period of selection of a sole line (scanning line).

For example, in the VGA standard display device, there are 480 lines, such that 480 discharge channels are formed. In this case, the respective lines are sequentially selected at a pre-set period (1H=horizontal period=32 $\mu$s). So, the discharge period allocated to a discharge channel of each line is (1H=32 $\mu$s at the maximum.

In the illustrated example, the discharging period is set to be not longer than 1H, such as to 13 $\mu$s, in order to complete the discharging of the discharge channel and the writing of picture signals during the 1H period. Specifically, a selection pulse with a pulse width of 13 $\mu$s is applied to discharge a discharge channel during the first half of the 1H period and picture signals are written in the latter half of the 1H period. It is because picture signals are written in the course of resetting to the original state after discharge.

In a timed relation to end of discharge for a line 1, corresponding picture signals 1 are written. In the next horizontal period, the line 2 is selected and corresponding picture signals 2 are written. In the next horizontal period, the line 3 is selected and corresponding picture signals 3 are written The line 4 then is selected to write corresponding picture signals 4. Thus, in the conventional driving method, since the selection pulse width allocated to a line is limited in the conventional driving method, there lacks tie degree of freedom in setting the discharge voltage Vu and the discharge current Iu necessary in uniform writing of picture signals.

Since stable plasma discharge is induced with a limited selection pulse width, the discharge voltage Vu and the discharge current Iu were set to higher value states with a certain allowance. In particular, if the discharge current is high, the damage to the electrode material is increased, such that practically sufficient panel durability cannot be assured.

SUMMARY OF THE INVENTION

It is therefore an object of the present invention to provide a plasma addressing display device that is free from the above-mentioned drawbacks.

The following means are used to overcome the aforementioned problems. That is, a plasma addressing display device according to the present invention includes:

a display cell having columns of signal electrodes and including a plasma cell having rows of discharge channels, with pixels formed at intersections of said signal electrodes and said discharge channels, a scanning circuit for sequentially discharging the columns of the signal electrodes at a pre-set period to select pixels from row to row, and a signal circuit for supplying picture signals to said columns of the signal electrodes to write said picture signals in the pixels of the selected row. The scanning circuit discharges each discharge channel with time shift as the discharging period allocated to the discharge channel of a previous row is partially overlapped at least with the discharging period allocated to the discharge channel of the next row to allocate a discharging period longer than said pre-set period to each discharge channel. In this case, the signal circuit supplies picture signals to be written in pixel in a row in question to each signal electrode in a timed relation to the end of the discharging period allocated to each discharge channel.

In a preferred embodiment of the present invention, a plasma addressing display device is such that each discharge channel has at least an anode electrode and a cathode electrode allocated thereto and is demarcated by a partition from a neighboring discharge channel;

each partition is arranged on said cathode electrode, which cathode electrode is co-used by two neighboring discharge channels separated by said partition; and wherein said scanning circuit applies a pre-set voltage to said cathode electrode, with the potential of the anode electrode, maintained at a grounding potential, as a reference, to cause the neighboring discharge channels to be discharged together, said scanning circuit sequentially applying a pre-set voltage to each cathode electrode with time shift from one cathode electrode to another.

Also provided is method for driving a plasma addressing display device, in which a display cell having columns of signal electrodes and a plasma cell having rows of discharge channels are layered together and in which pixels are provided at intersections of said signal electrodes and said discharge channels, said method including scanning processing for sequentially discharging the columns of signal electrodes at a pre-set period to select pixels from one row to another and signal processing for sequentially supplying picture signals to columns of signal electrodes in keeping with a pre-set period to write picture signals in the pixels of the selected row;

characterized in that said scanning circuit discharges each discharge channel with a time shift as the discharging period allocated to the discharge channel of a previous row is partially overlapped at least with the discharging period allocated to the discharge channel of the next row to allocate a discharging period longer than said pre-set period to each discharge channel, Id this case, the signal circuit supplies picture signals to be written in pixel in a row in question to each signal electrode in a timed relation to the end of the discharging period allocated to each discharge channel.

According to the present invention, the discharging period allocated to a discharge channel of a previous row is partially overlapped with that allocated to the discharge channel of the next row so that the discharge channels will be discharged with a time shift. Stated differently, the scanning of the plasma cell is by the "concurrent plural line discharging system," in which at least two lines are discharged simultaneously, instead of conventional line-based discharging. With this "concurrent plural line discharging system," the discharging period allocated to each line (discharging pulse width) can be longer than the horizontal period (1H).

The result is that plasma discharge can be induced with stability in the respective discharge channels so that the discharging voltage or current necessary for uniform writing can be diminished correspondingly. The discharging voltage or current diminishing effect is larger the larger the pulse width. In particular, the plasma cell durability can be elongated by diminishing the discharging current.

It has been confirmed that, in a plasma cell built into the plasma addressing display device, the plasma cell durability is inversely proportionate to the fourth power of the discharging current. In addition, in a preferred embodiment of the present invention, the cathode electrode is formed below the partition and two mutually neighboring discharge channels are soused, These two discharge channels may be discharged simultaneously by applying a pre-set discharging voltage to the cathode electrode. If the application of the discharge voltage to the respective cathode electrodes is sequentially shifted, e.g., by 1H, up to a maximum of 1H of the discharging time is obtained in each discharge channel. Moreover, since the time of voltage application to each cathode electrode is 1H at the maximum, it is half that in the routine system. Since the damage can be halved by halving the discharge voltage application dime to the cathode electrode, the durability can be elongated to twice that in the routine "concurrent plural line discharging system."

According to the present invention, described above, in which the "concurrent plural line discharging system" is used, discharging period longer than the horizontal period can be allocated to each discharging channel. Since the discharging period can now be longer, the discharging voltage or current required for uniform writing of picture signals can be diminished, so that it is possible to prolong the durability of the plasma cell built into the plasma addressing display device. Since the discharging current is now reduced, the power consumption of the entire panel can be decreased unless the discharging period is prolonged excessively.

DESCRIPTION OF THE PREFERRED EMBODIMENTS

Figure 1:
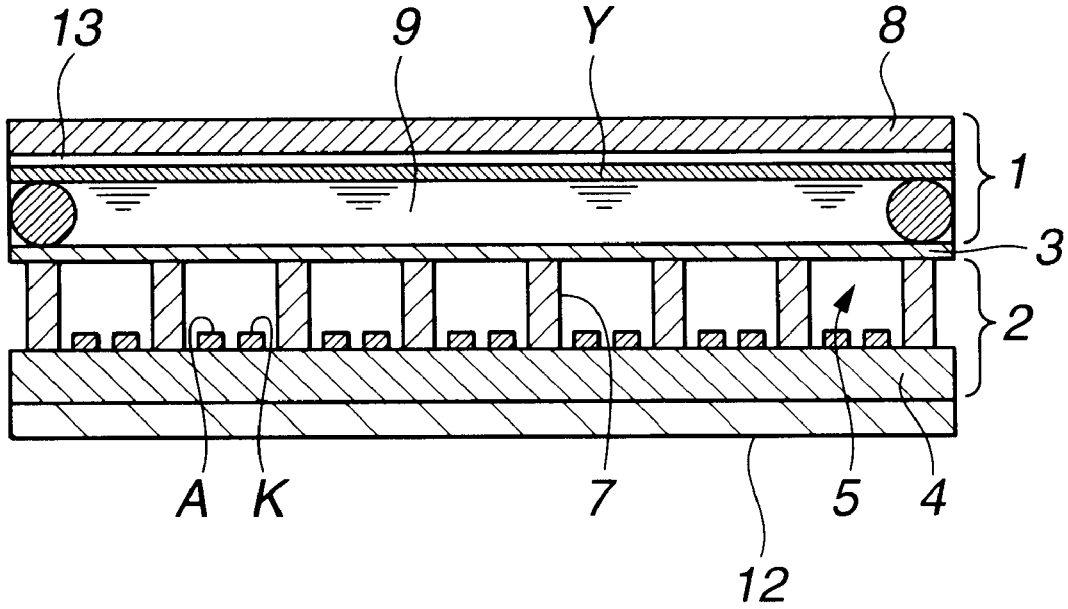
FIG.1 (RELATED ART)
FIG. 1 is a cross-sectional view showing an example of a conventional plasma addressing display device.
Figure 2:
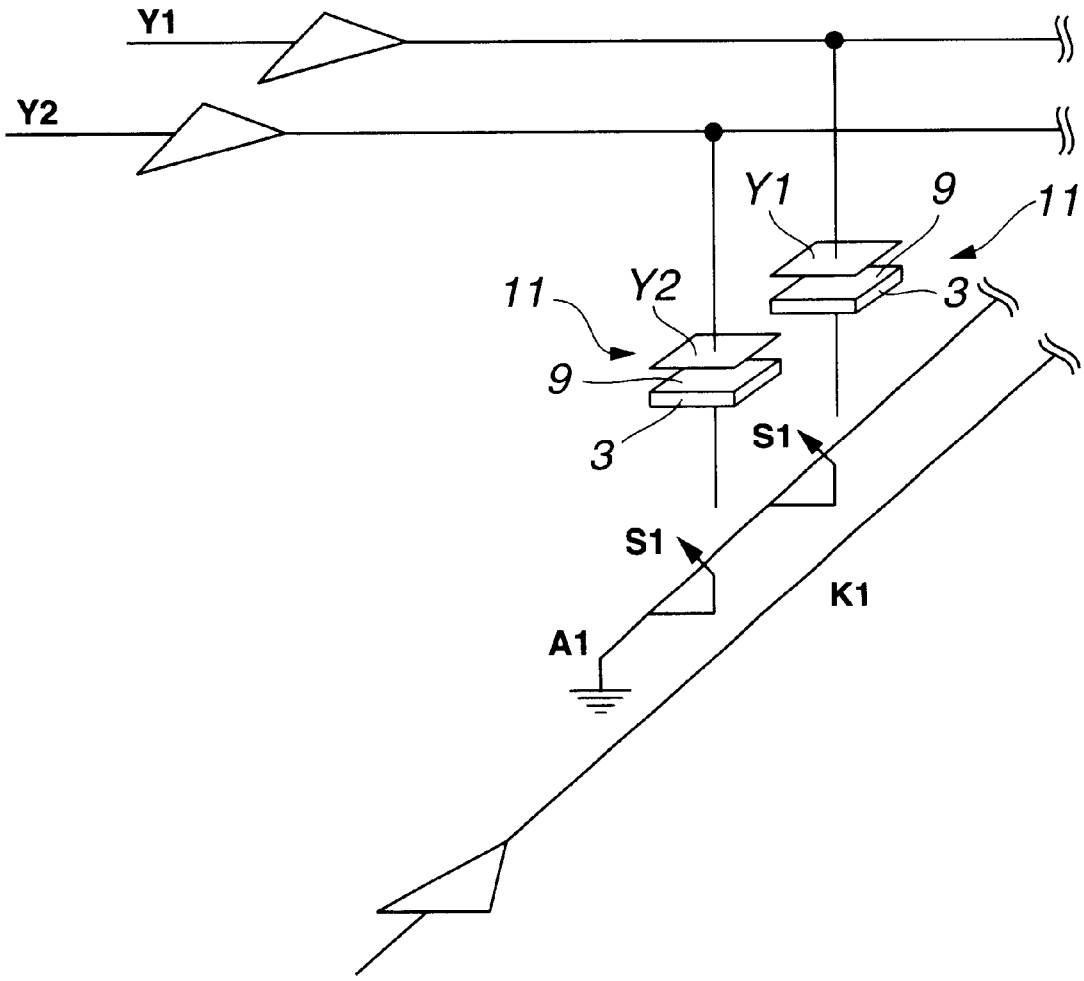
FIG.2 (RELATED ART)
FIG. 2 is a schematic view for illustrating the operation of the conventional plasma addressing display device.
Figure 3:
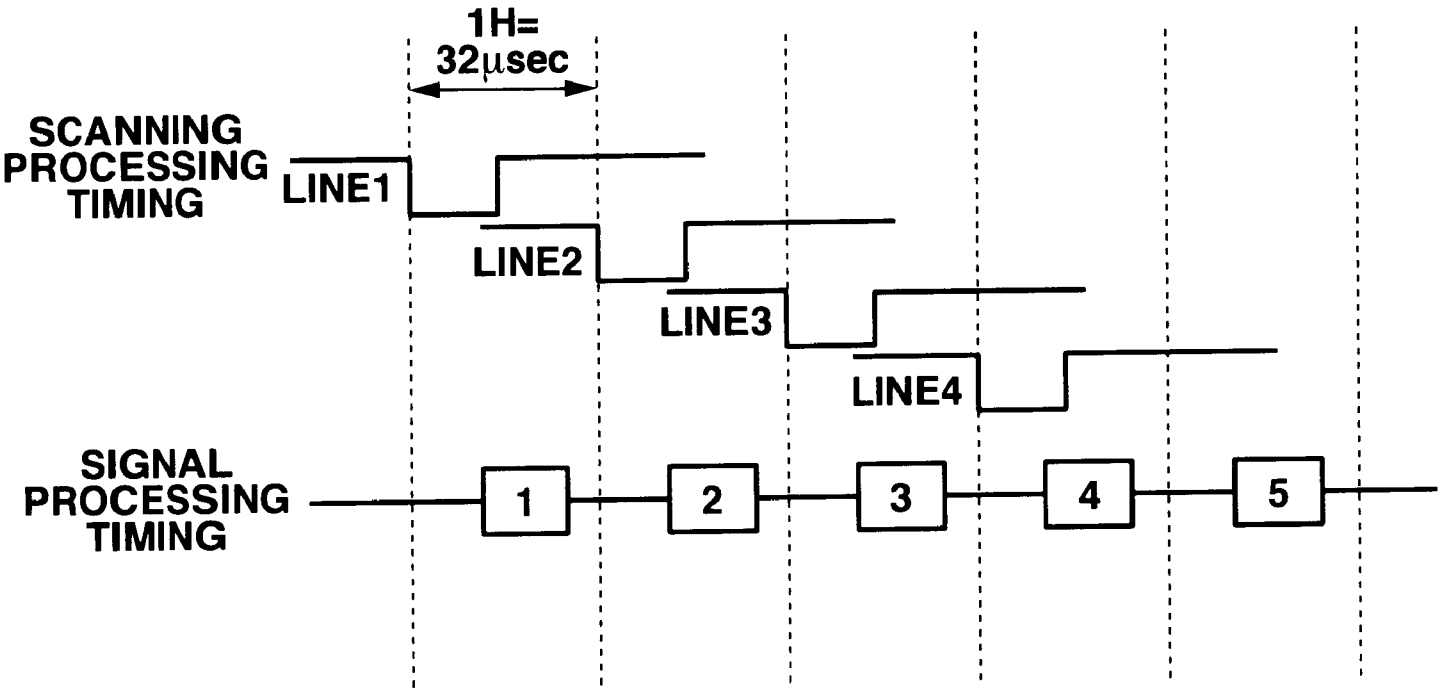
FIG.3 (RELATED ART)
FIG. 3 is a timing chart for illustrating the operation of the conventional plasma addressing display device.

Referring to the drawings, preferred embodiments of according to the present invention will be explained in detail.

Figure 4:
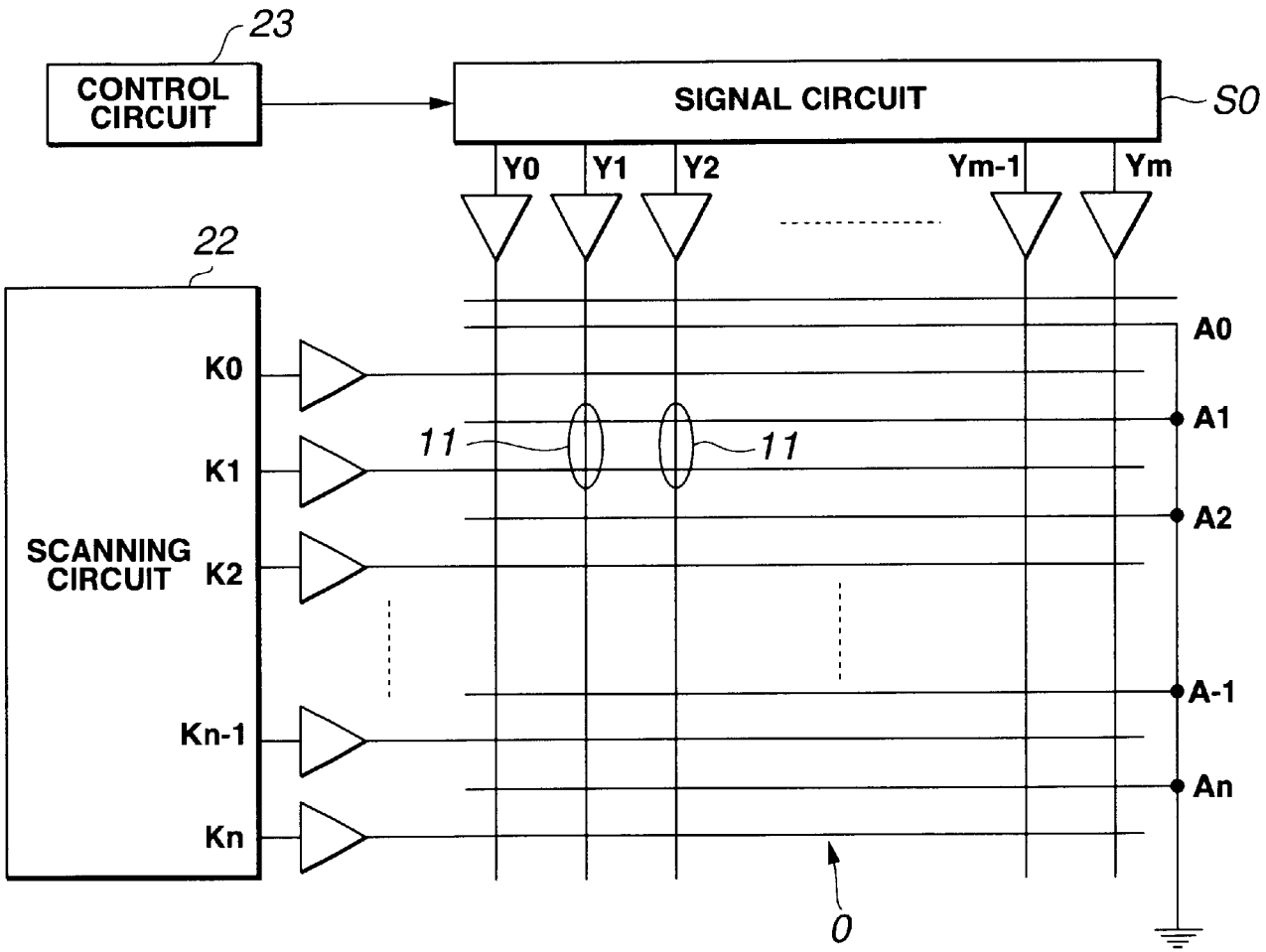
FIG. 4 is a schematic block diagram showing a plasma addressing display device according to the present invention.

FIG. 4 is a schematic view showing a basic structure of a plasma addressing display device according to the present invention. As shown,the present plasma addressing display device is made up mainly of a panel 0, a peripheral signal circuit 21, a scanning circuit 22 and a control circuit 23. The panel 0 is basically made up of a display cell for modulating an incident light beam into an outgoing light beam, responsive to picture signals, to make picture display, and a plasma cell surface-bonded to this display cell to scan the display cell.

The plasma cell includes a pair of discharge electrodes and is driven for discharging by the scanning circuit 22. One of the paired discharge electrodes operates as a cathode K, with the other operating as an anode A. The scanning circuit 22 sequentially applies selection pulses to the cathodes K0 to Kn to scan the display cells.

On the other hand, the anodes A0 to An are grounded or coupled to a reference potential. The display cells include signal electrodes Y0 to Ym, arrayed in columns, and which define pixels 11 at the intersections thereof with the discharge channels. The signal circuit 21 applies picture signals to the signal electrodes Y0 to Ym, in synchronism with the line sequential scanning of the discharge channels, to modulate incident light beam every pixel. The control circuit 23 performs synchronization control between the signal circuit 21 and the scanning circuit 22.

As characteristic of the scanning circuit 22, discharge of the respective discharge channels is caused to occur with time offset relative to one another as the discharging period allocated to the discharge channel of the previous row is partially overlapped with the discharging period allocated to the discharge channel of the next row, thereby enabling a discharge channel longer than a pre-set horizontal scanning frequency to be allocated to each discharge channel.

In keeping therewith, the signal circuit 21 sends picture signals to be written in pixels 11 of the row in question to the signal electrodes Y0 to Ym at a time point when the discharging period allocated to each discharge channel comes to a close.

Each discharge channel has a set of an anode A and a cathode K, and a gas which is discharged responsive to a selection pulse applied to the cathode of the paired electrodes from the scanning circuit 22. This gas is an inert gas, such as argon or xenon. In the present invention, the plasma cell may be improved in durability by employing the above-mentioned "concurrent plural line discharging system" as the driving system.

Figure 5:
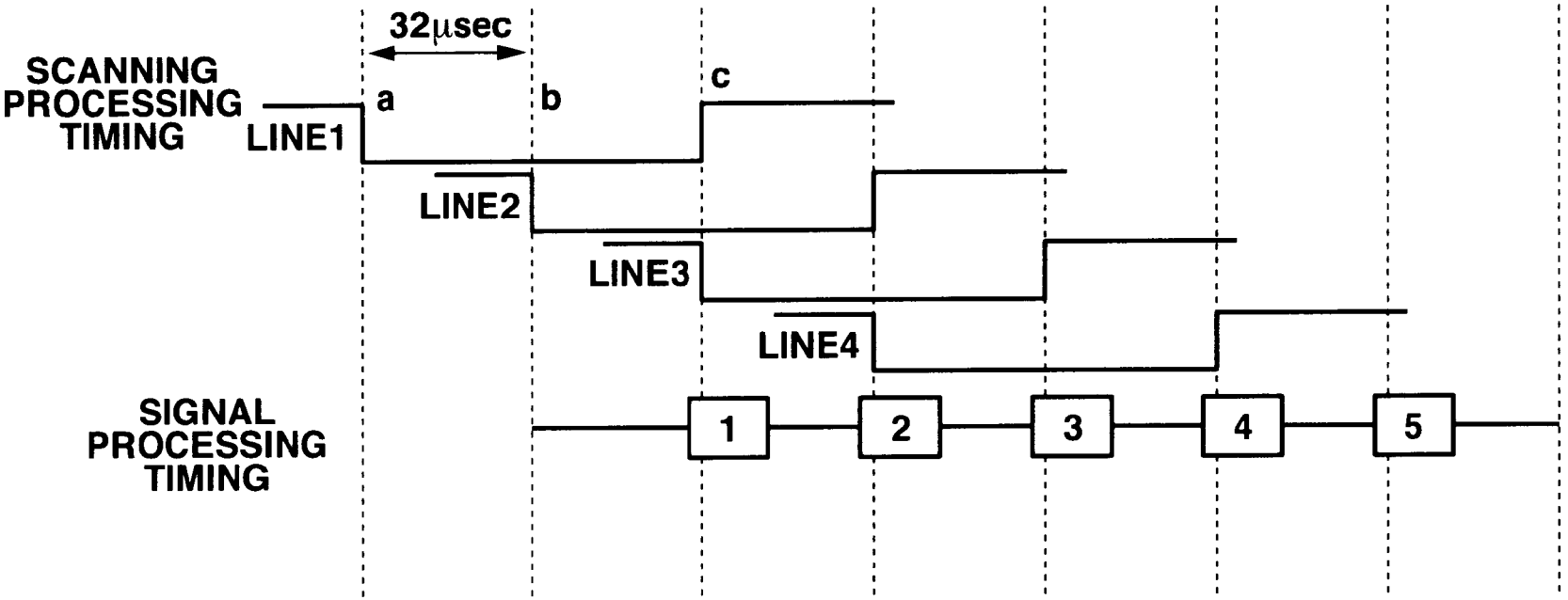
FIG. 5 is a timing chart for illustrating the operation of a plasma addressing display device according to the present invention.

FIG. 5 is a timing chart showing a specified example of the "concurrent plural line discharging system" according to the present invention. The present embodiment is applied to a VGA standard display device, with the number of discharging lines being 480 and with the horizontal period being 32 $\mu$s.

In the present embodiment, the discharging period that can be allocated to a single line is 2H=64 $\mu$s. If the discharging period of 64 $\mu$s is allocated to each channel, the discharging timing of lines 1 and 2, for example, is as follows:

First, the line 1 starts discharging at a timing a. Since the line 2 starts discharging at a time point b when 32 $\mu$s (1) has elapsed, the lines 1 and 2 are discharging simultaneously during the period of 32 $\mu$s as from a time point b until a time point c as shown. That is, two lines are discharging simultaneously. The writing of picture signals in the line 1 commences directly ahead of the time point c when the line 1 has completed its discharging.

For example, such writing commences a few$\mu$s ahead of the time point c. In actuality, since the lines 2 and 3 are discharging when picture signals are being written in the line 1, the picture signals to be written in the line 1 are momentarily written in the lines 2 and 3.

However, this period is 2 lines/480 lines so that it amounts to only 0.4% of the entire frame and hence it is scarcely problematical in viewing a picture. Although a discharge pulse in the present embodiment is of a simple rectangle extending continuously for 2H, it may also be split, if so desired. For example, although the discharge pulse for the line 1 continues from the time point a until the time point c, it may also be split at the time point b into left and right portions. This raises no practical problem unless the pulse durations of the left and right portions do not affect discharge durability.

Figure 6:
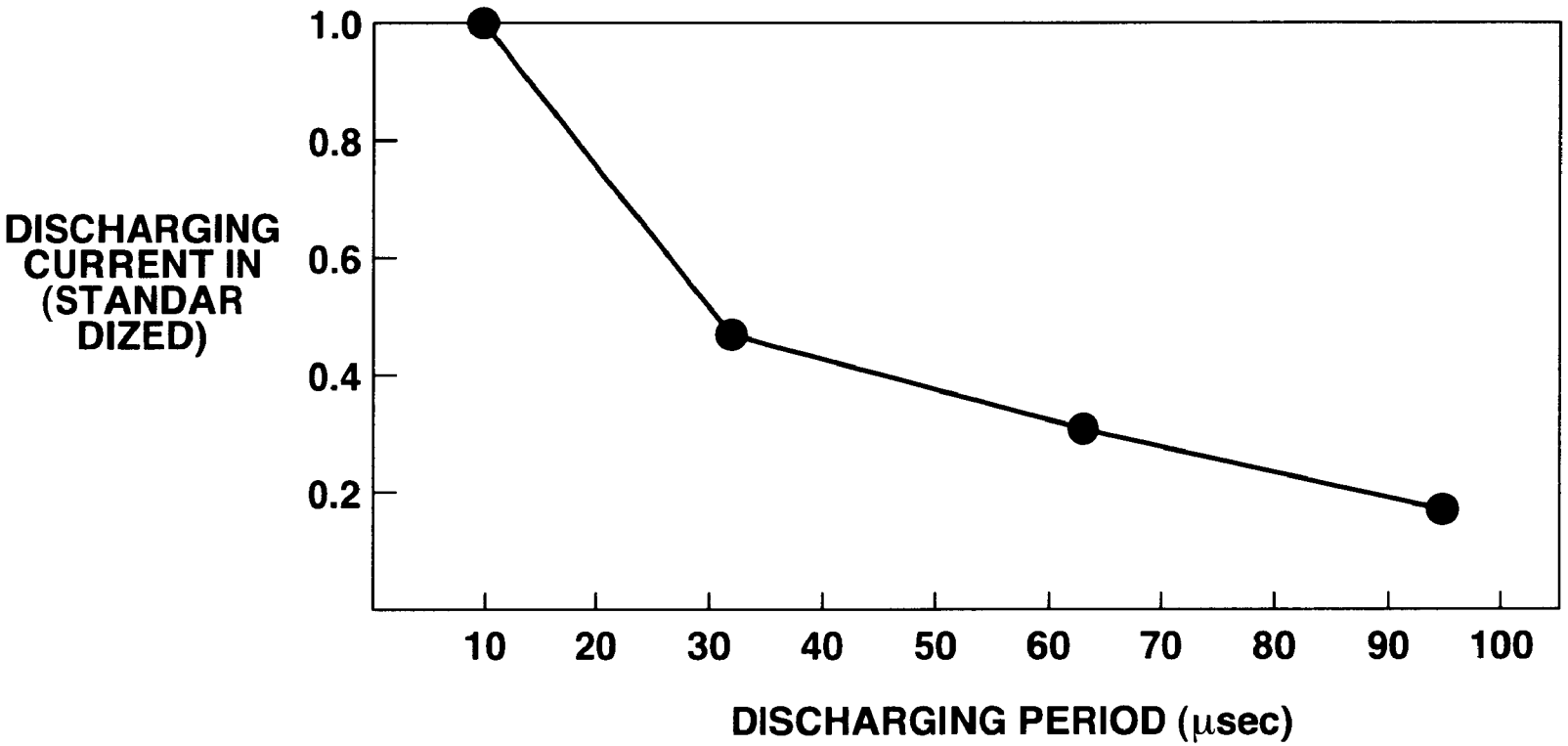
FIG. 6 is a graph showing the relation between the discharge period and the discharge current in the plasma addressing display device according to the present invention.

FIG. 6 is a graph showing the relation between the discharging period allocated to a given discharge channel and the discharging current Iu necessary for stable writing. The discharging time is in the practical unit of$\mu$s, with the discharging current Iu being a normalized value. For normalization, the discharge current flowing during a routine discharging period of 13 $\mu$s is set to 1.0.

As may be seen from the graph, the discharging current Iu necessary for stable writing can be decreased significantly if the discharging period (discharge pulse width) is increased. It may be seen from the above results that, if the discharging current is increased gradually from approximately 10 $\mu$s, the discharging current can be reduced to approximately one-half at 30 μs, whilst it can be reduced to approximately one-fourth at 96 μs.

Thus, if the "concurrent plural line discharging system" according to the present invention is employed, the discharging period per line can be longer than heretofore, thus enabling the discharging current to be suppressed.

As for the relationship between the discharging current and the plasma cell, the present inventors have found a new fact. That is, it has been confirmed that the durability of the plasma cell built into the plasma addressing display device is inversely proportionate to the fourth power of the discharging current Iu. Specifically, if the discharging current is one-half the conventional value, the durability of the plasma cell can be improved by a factor of 24=16. Meanwhile, the plasma cell durability can be extended by employing the "concurrent plural line discharging system" according to the present invention.

For example, in case of concurrent two line discharging, the discharging current required for writing uniform picture signals is approximately one-third of the discharging current required in the conventional system. So, simple computation from the quadruple rule recognized between the above-mentioned plasma cell and the discharging current gives the plasma cell durability improving factor equal to $3^4$=81. It is noted however that the time during which the discharging current flows (discharging period) is 64 μs/13 As which is approximately five times the value in the conventional system. Therefore, in resality, it may be calculated that the durability can be expected to be improved by a factor of 81/5 or, approximately 16.

Figure 7:
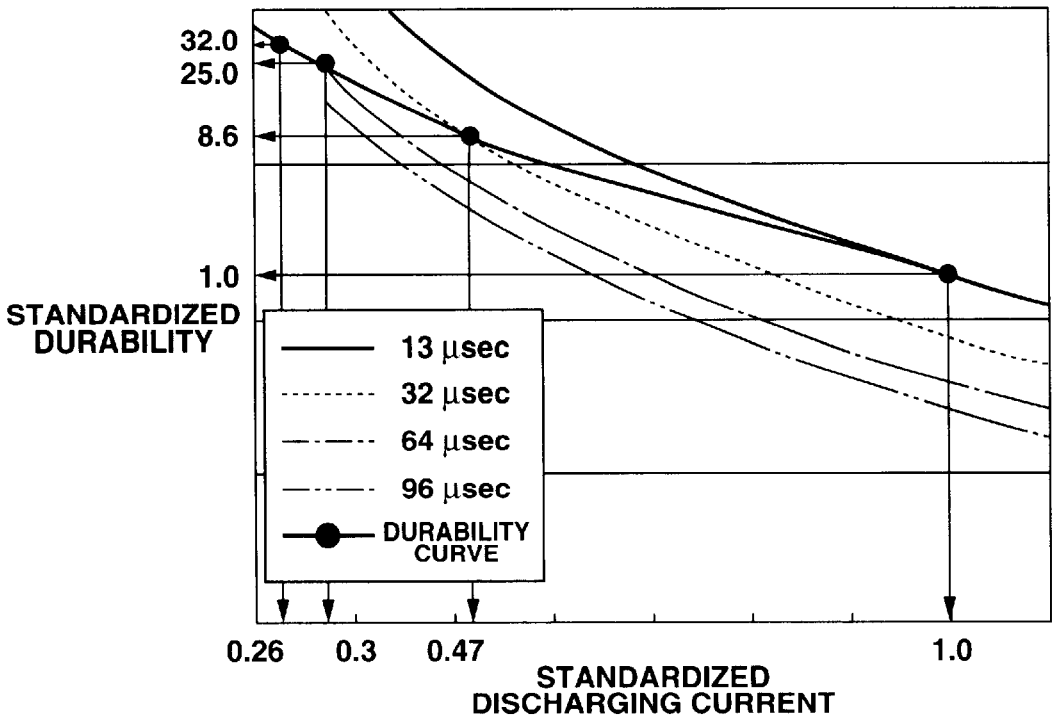
FIG. 7 is a graph showing the relation between the discharge current and durability in the plasma addressing display device according to the present invention.

FIG. 7 shows the relation between the discharging current and the plasma cell durability. In this graph of FIG. 7, the normalized discharging current and the normalized durability are taken on the abscissa and on the ordinate, respectively. In this graph, the minimum discharging current necessary for stable discharge In with the routine discharging periodμs is set to 1.0, with the plasma cell durability in this case set to 1.0. In the graph of FIG. 7 the relation between the discharging current and the durability is plotted for the discharging periods of 13 μs, 32 μs, 64 μs and 96 μs.

By way of example, if attention is directed to the curve for the discharging period of 13 μs, the normalized durability is becomes larger, beginning from 1.0, as the discharging current is decreased, beginning from 1.0. However, in actuality, the discharging current cannot be reduced infinitesimally, such that the discharging current for realizing the writing necessary for writing the uniform picture signals is 1.0 as a normalized value. Similarly, the discharging current/durability curve for 32 Ks is rising towards left. However, the cirve has a downward shift from the curve for 13 μs, in an amount corresponding to the long discharging period. The curves for 64 μs and for 96 μs sequentially show downward shifts.

However, if the discharging period is set to a longer value, the value of the discharging current φu necessary for witing uniform picture signals is decreassed, as explained with reference to FIG. 6. For example, the value of the normalized discharging current for 32 μs and that for 64 μs are approximately halved to 0.47 and reduced to one third or approximately 0.3. The discharging current Iu can be further reduced for 96 μs. As may be seen from this durability curve, the longer the discharging period, the longer may become the durability of the plasma cell.

First Embodiment

Figure 8:
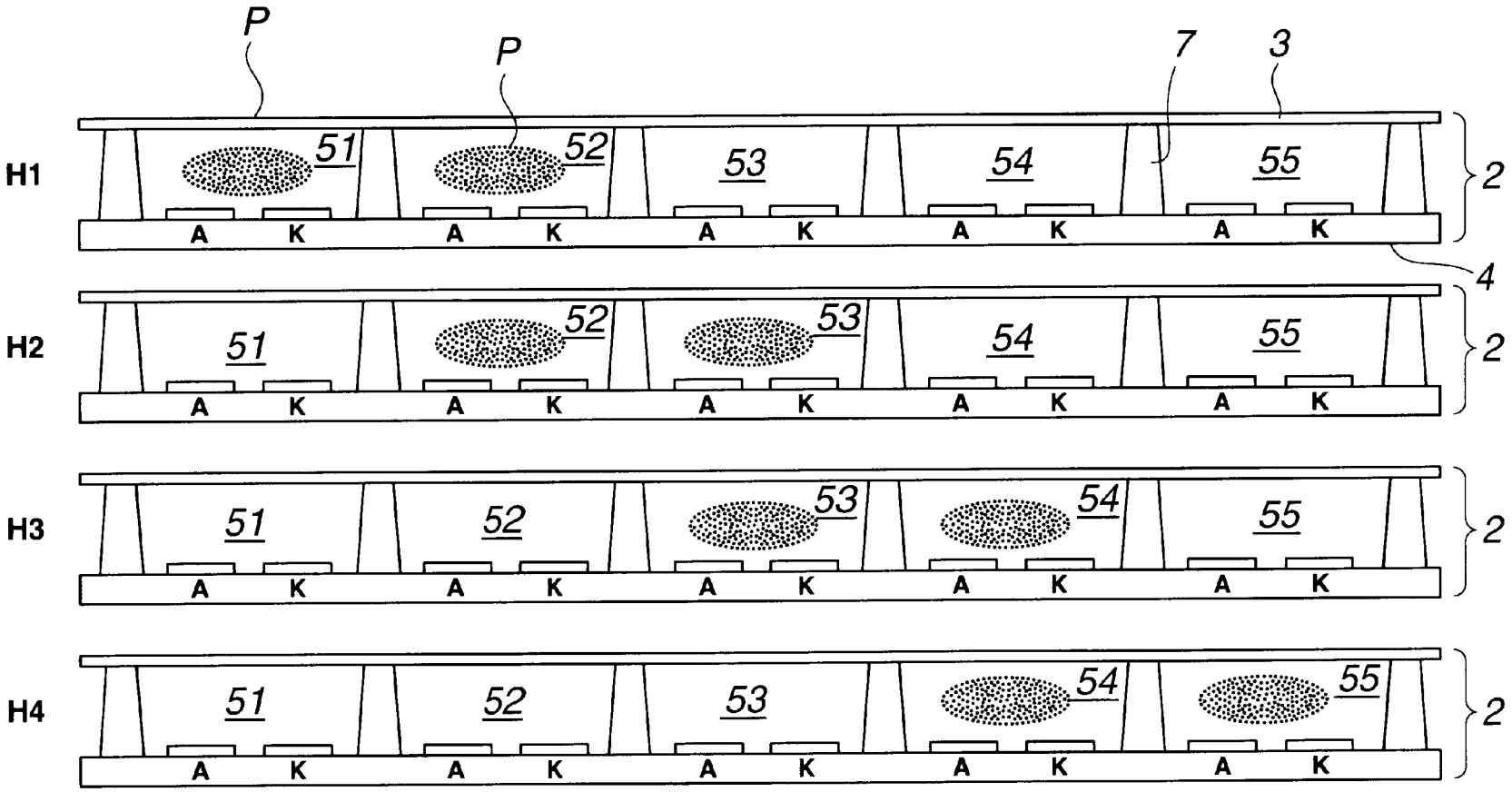
FIG. 8 is a schematic view showing a first embodiment of a plasma cell built into the plasma addressing display device according to the present invention.

FIG. 8 schematically shows a first embodiment of a panel built into the plasma addressing display device shown in FIG. 4. Specifically, FIG. 8 shows only the plasma cell 2 of the panel 0. As shown, the plasma cell 2 is made up of a substraste 4 and an intermediate sheet 3, separated from each other with a pre-set gap in-between. This gap is split by partitions 7 to constitute plural discharge channels. In FIG. 8, there are defined five discharge channels 51 to 55, to each of which is allocated an electrode set of an anode A and a cathode K.

The plasma cell is driven by the "concurrent plural line discharging system" according to the present invention. For example, a pulse is applied to the cathode K of the discharge channel 51 during the initial horizontal period H1 to generate a plasma discharge P. Simultaneously, a selection pulse is applied to the cathode K belonging to the neighboring discharge channel 52 so that plasma discharge P is produced simultaneously.

Meanwhile, the anode A of the discharge channel is grounded. In the next horizontal period H2, there are applied pulses to the cathode K of the discharge channel 52 and to the cathode K of the neighboring discharge channel 53. This produces the plasma discharge P in the discharge channels 52, 53.

In a similar manner, plasma discharge is produced in the discharge channels 53, 54 in the next horizontal period H3, whilst plasma discharge is produced in the discharge channels 54, 55 in the next horizontal period H4.

This operation is now scrutinized chronologically. Regarding the center discharge channel 53, plasma discharge is produced in the second horizontal period H2 and subsequently in the third horizontal period H3. Therefore, the discharge time allocated to the discharge channel 53 is 2H which is twice that in the conventional system at the maximum.

By elongating the discharging time, each discharge channel can excite plasma discharge in stability such that the discharging voltage or the discharging current necessary for uniform writing can be correspondingly reduced. However, the time duration of the voltage pulse applied to each cathode K is 2H at the maximum, thus correspondingly increasing the damage.

However, since the positive effect obtained by elongating the discharging time of each discharge channel more than offsets the negative effect caused by the elongated voltage application time to the respective cathodes, thus realizing corresponding prolonged durability.

Second Embodiment

Figure 9:
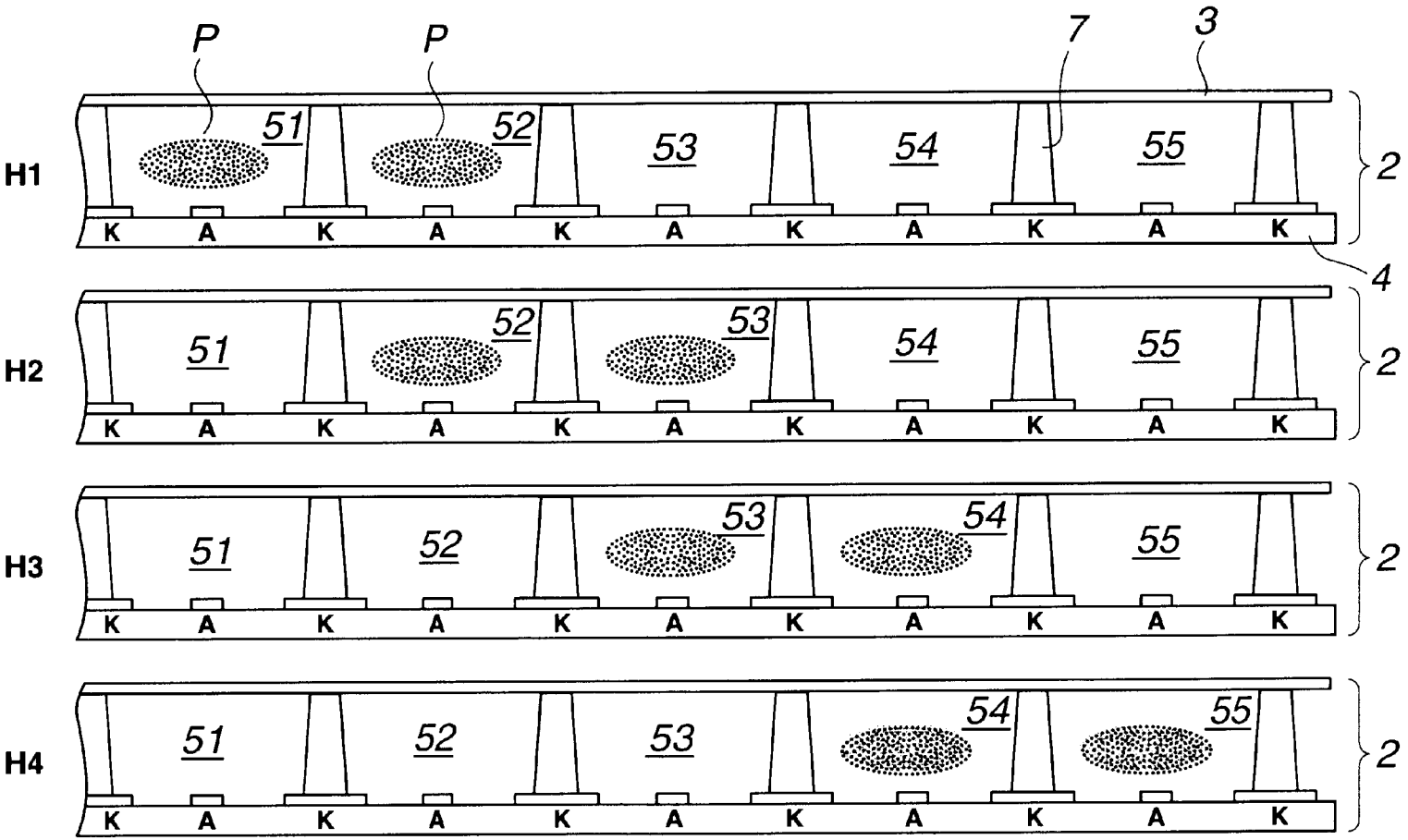
FIG. 9 is a schematic view showing a second embodiment of a plasma cell built into the plasma addressing display device according to the present invention.

FIG. 9 schematically shows a second embodiment of the panel built into the display device shown in FIG. 4. In the present embodiment, plural partitions 7 are formed on top of the cathodes K. In other words, the cathodes are co-used by respective neighboring discharge channels.

On the other hand, an anode connected to a grounding potential is arranged centrally of each discharge channel. In the first horizontal period H1, a selection pulse is applied to the cathode K arranged below the partition 7 separating the discharge channels 51, 52 from each other.

This generates plasma discharge P from the discharge channels 51, 52 simultaneously. In the second horizontal period H1, a selection-pulse is applied to the cathode K arranged below the partition separating the discharge channel 51 from the discharge channel 52. This generates plasma discharge in the discharge channels 52, 53.

In a similar manner, plasma discharge is produced in the discharge channels 53, 54 in the third horizontal period H3. This operation is now scrutinized chronologically.

Regarding the central discharge channel 53, first plasma discharge is produced in the second horizontal period H2 and second plasma discharge is produced in the third horizontal period H3. Therefore, the total discharging time in the discharge channel 53 reaches 2H at the maximum thus realizing reduction in the discharging voltage and in the discharging current as in the first embodiment shown in the first embodiment shown in FIG. 8.

In the discharge channel 53, a selection pulse is applied to the left side cathode K, whilst a selection pulse is similarly applied to the right side cathode K in the third horizontal period H3. Thus, insofar as a single cathode is concerned, the pulse application time is 1H at the maximum, which is one-half the value in the first embodiment shown in FIG. 8. Therefore, the plasma cell durability can be prolonged by a factor of two as compared to the first embodiment.

In the illustrated structure, in which the cathode acts on the two neighboring discharge channels, it is possible to generate charged particles in two neighboring channels by sole charging, If discharging is fed sequentially by 1H, the discharging time of 2H at the maximum can be obtained in each channel. Since the time during which is applied to each cathode K is 1H at the maximum, damages to the cathode K can be halved, and hence the durability is doubled, in comparison with the case wherein 2H discharging is caused to occur in the structure of FIG. 8 in addition, since the partition 7 is provided on the cathode K, it is possible to prevent electrode material from being scattered from the cathode K due to sputtering by plasma discharge, thus suppressing the picture quality from being lowered.

Third Embodiment

Figure 10:
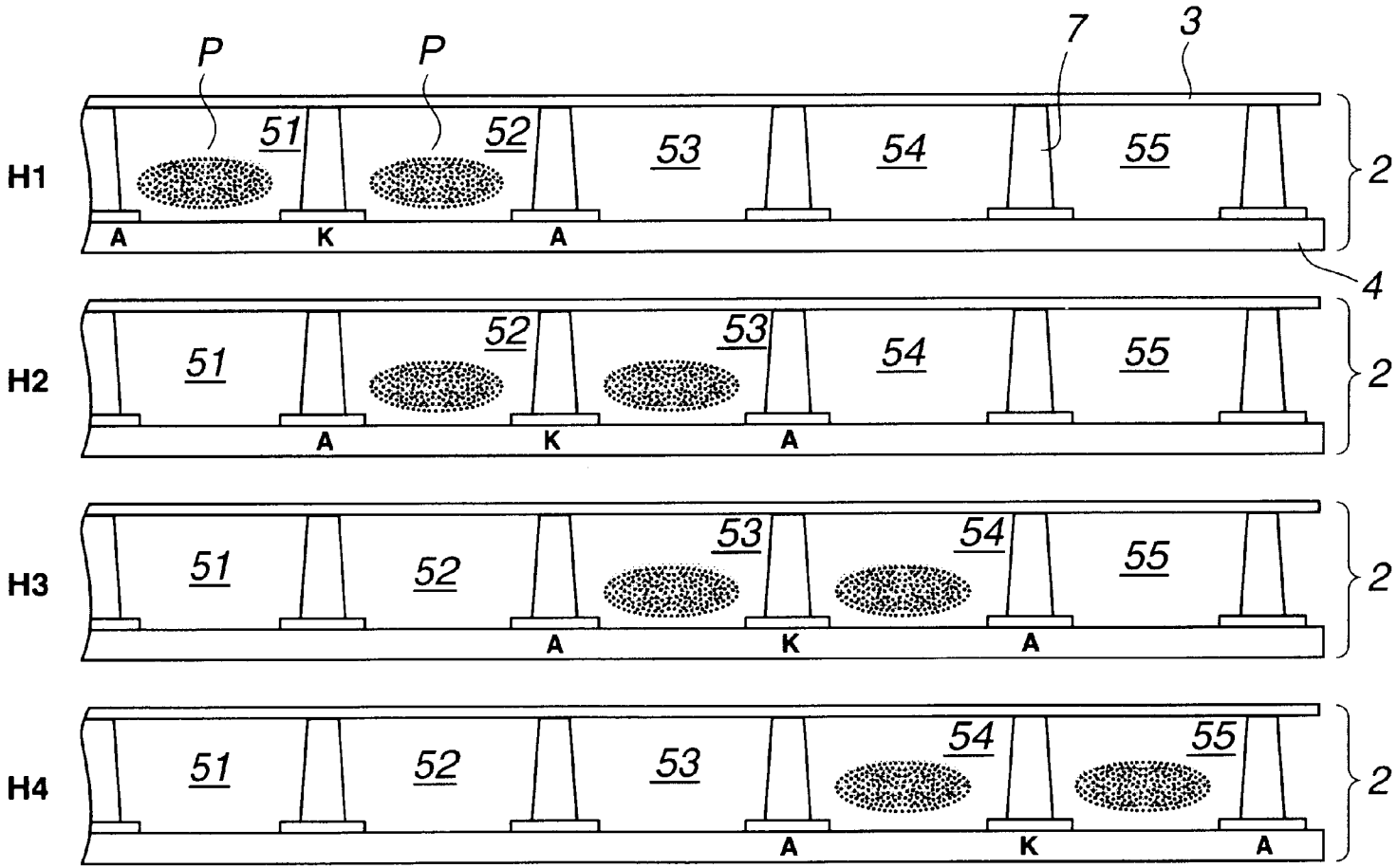
FIG. 10 is a schematic view showing a third embodiment of a plasma cell built into the plasma addressing display device according to the present invention.

FIG. 10 schematically shows a third embodiment of the present invention in which plural partitions 7 are formed on each discharging electrode, with the respective discharging electrodes performing the functions of the anode A and the cathode K alternately every 1H period. In the first horizontal period H1, the discharging electrode lying below the partition 7 separating the discharge channels from each other operates as a cathode K whilst discharging electrodes on both sides thereof operates as an anode A. This generates plasma discharge P simultaneously in the discharge channels 51,52.

In the second horizontal period H2, the discharging electrode lying below the partition 7 separating the discharge channels from each other operates as a cathode K, whilst discharging electrodes on both sides thereof operate as an anode A. This generates plasma discharge simultaneously in the discharge channels 52, 53.

In a similar manner, plasma discharge is produced in the discharge channels 53, 54 in the third horizontal period H3, whilst plasma discharge is produced simultaneously in the discharge channels 53, 54 in the fourth horizontal period H4.

This operation is now scrutinized chronologically. Regarding the central discharge channel 53, first plasma discharge is produced in the second horizontal period H2 and second plasma discharge is produced in the third horizontal period H3. Therefore, the total discharging time in the discharge channel 53 reaches 2H at the maximum, so that the discharging period allocated per line can be longer than 1H.

The result is that stable plasma discharge can be induced in each discharge channel so that the discharging voltage or current necessary for uniform writing can be diminished correspondingly. Moreover, the voltage pulse application time to each cathode K is 1H at the maximum, as in the second embodiment shown in FIG. 9, thus halving the pulse application time as compared with that in the first embodiment shown in FIG. 8.

What is claimed is:

1. A plasma addressing display device comprising:

a flat panel including a display cell having columns of signal electrodes and also including a plasma cell having rows of discharge channels, with pixels formed at intersections of said signal electrodes and said discharge channels, a scanning circuit for sequentially discharging the columns of the signal electrodes at a pre-set period to select pixels from row to row, and a signal circuit for supplying picture signals to said columns of the signal electrodes to write said picture signals in the pixels of the selected row;

characterized in that, said scanning circuit discharges each discharge channel with a time shift is the discharging period allocated to the discharge channel of a previous row being partially overlapped at least with the discharging period allocated to the discharge channel of the next row to allocate a discharging period longer than said pre-set period to each discharge channel.

2. The plasma addressing display device according to claim 1 wherein, said signal circuit supplies picture signals to each signal electrode in a timed relation to the end of the discharging period allocated to each discharge channel.

3. The plasma addressing display device according to claim 1 wherein, each discharge channel has at least an anode electrode and a cathode electrode allocated thereto and is demarcated by a partition from a neighboring discharge channel;

each partition is arranged on said cathode electrode, which cathode electrode is co-used by two neighboring discharge channels separated by said partition; and said scanning circuit applies a pre-set voltage to said cathode electrode, with the potential of the anode electrode, maintained at a grounding potential, as a reference, to cause the neighboring discharge channels to be discharged together, said scanning circuit sequentially applying a pre-set voltage to each cathode electrode with time shift from one cathode electrode to another.

4. A method for driving a plasma addressing display device, in which a display cell having columns of signal electrodes and a plasma cell having rows of discharge channels are layered together and in which pixels are provided at intersections of said signal electrodes and said discharge channels, said method including the steps of:

scanning processing for sequentially discharging the columns of signal electrodes at a pre-set period to select pixels from one row to another, and signal processing for sequentially supplying picture signals to columns of signal electrodes in keeping with a pre-set period to write picture signals in the pixels of the selected row;

characterized in that said scanning processing discharges each discharge channel with time shift with a discharging period allocated to the discharge channel of a previous row being partially overlapped at least with the discharging period allocated to the discharge channel of the next row to allocate a discharging period longer than said pre-set period to each discharge channel.

5. The method for driving the plasma addressing display device according to claim 4 wherein said signal processing supplies picture to each signal electrode in a timed relation to the end of the discharging period allocated to each discharge channel.

6. The method for driving the plasma addressing display device according to claim 4 wherein, each discharge channel has at least an anode electrode and a cathode electrode allocated thereto and is demarcated by a partition from a neighboring discharge channel;

each partition is arranged on said cathode electrode, which cathode electrode is co-used by two neighboring discharge channels separated by said partition; and said scanning processing applies a pre-set voltage to said cathode electrode, with the potential of the anode electrode, maintained at a grounding potential, as a reference, to cause the neighboring discharge channels to be discharged together, said scanning processing sequentially applying a pre-set voltage to each cathode electrode with time shift from one cathode electrode to another.

* * * * *